US007793450B2

(12) United States Patent
Chasmer et al.

(10) Patent No.: US 7,793,450 B2
(45) Date of Patent: Sep. 14, 2010

(54) DISPLAY PANEL AND DISPLAY SYSTEM

(75) Inventors: Godfrey Victor Chasmer, Hazeleigh Grange, Burnham Road, Hazeleigh, Essex (GB) CM3 6QS; Gennady Balashov, Moscow (RU)

(73) Assignees: OOO Abbott, Moscow (RU); Godfrey Victor Chasmer, Hazeleigh, Essex (GB)

( * ) Notice: Subject to any disclaimer, the term of this patent is extended or adjusted under 35 U.S.C. 154(b) by 446 days.

(21) Appl. No.: 11/720,698

(22) PCT Filed: Dec. 2, 2005

(86) PCT No.: PCT/GB2005/050229

§ 371 (c)(1),
(2), (4) Date: Jun. 1, 2007

(87) PCT Pub. No.: WO2006/059160

PCT Pub. Date: Jun. 8, 2006

(65) Prior Publication Data

US 2009/0165342 A1 Jul. 2, 2009

(30) Foreign Application Priority Data

Dec. 3, 2004 (GB) ..... 0426634.2

(51) Int. Cl.
*A47G 7/00* (2006.01)

(52) U.S. Cl. ..... 40/657; 211/94.01

(58) Field of Classification Search ..... 40/657; D6/509; 211/94.01; 248/231.9
See application file for complete search history.

(56) References Cited

U.S. PATENT DOCUMENTS

| | | | | |
|---|---|---|---|---|
| 3,981,118 | A * | 9/1976 | Johnson et al. | 52/716.8 |
| 4,615,448 | A * | 10/1986 | Johnstonbaugh | 211/94.01 |
| 5,138,803 | A | 8/1992 | Grossen et al. | |
| 6,363,645 | B1 | 4/2002 | Hunter | |
| D486,676 | S * | 2/2004 | Campbell et al. | D6/491 |

* cited by examiner

*Primary Examiner*—Joanne Silbermann
(74) *Attorney, Agent, or Firm*—Andrus, Sceales, Starke & Sawall, LLP

(57) ABSTRACT

A display panel (10) has a plurality of T-shaped slots (12) extending thereacross, for receiving hangers (35) for products. An insert (19) is provided for each slot (12), which insert is made of metal and has a suitable shape to permit the insert (19) to be rolled into the slot from the front face (11) of the panel (10), with only minimal deformation of the insert. A channel (24) is formed along the free edge (23) of an arcuate leg (21) of the insert (19), the channel (24) being directed outwardly whereby a corner region (33) between the outer face (11) of the panel (10) and one side of the slot (12) may locate in the channel (24), so as to secure the insert (19) in position, in the slot.

15 Claims, 4 Drawing Sheets

DISPLAY PANEL AND DISPLAY SYSTEM

CROSS REFERENCE TO RELATED APPLICATION

The present application is the U.S. national stage application of International Application PCT/GB2005/050229, filed Dec. 2, 2005, which international application was published on Jun. 8, 2006 as International Publication WO 2006/059160. The International Application claims priority of British Patent Application 04 26634.2, filed Dec. 3, 2004.

This invention relates to a display panel to permit the display of goods for example in retail, exhibition and office environments. The invention further relates to a display system employing such a display panel but including one or more carriers for goods to be displayed.

So-called slat wall systems are well known for the display of goods. A typical system has a panel usually of wood, a wood based product such as MDF (medium density fibreboard) or of a plastics material which is provided with a plurality of parallel slots extending thereacross, each such slot being of L-shaped or T-shaped form. Hangers for the goods to be displayed are furnished at one end with an engagement region which has a joggle or hook formed in the end portion, permitting interengagement with a slot at a selected location by feeding the joggled or hook end portion of the hanger into the slot and then swinging downwardly the part of the hanger external to the slot. Once so engaged, the hanger is held in the slot and cannot be disengaged by a simple force applied to the hanger either vertically or horizontally away from the panel; to disengage the hanger, it must perform an upward swinging movement about a horizontal axis to disengage the joggle or hook from the undercut part of the slot.

Slat wall systems of the kind described above have been very widely employed commercially, since they afford great flexibility for the display of a wide variety of products. A simple manufacturing technique for a panel having L-shaped slots is to secure to a base panel a number of parallel undercut strips, whereas for a panel having T-shaped slots, the usual manufacturing technique is to machine the slots using an appropriately-shaped cutter, starting from a side edge of a panel and traversing the cutter across the panel to an opposed edge. Though the outer face of the panel itself or of the undercut strips may have an attractive surface finish, either procedure leaves exposed the internal surfaces of the slot. Locally, those internal surfaces will be covered by the hangers but between the hangers those surfaces will be visible, so can detract from the aesthetic quality of the finished display system. In order to overcome this disadvantage, it is known to fit into each slot a substantially rigid insert, for example of aluminium, an aluminium alloy, steel or a hard plastics material, appropriately profiled to match the cross-section of the slot. Such an insert must be fitted into the respective slot from an edge of the panel and then be slid along the length of the slot.

A further advantage of using a substantially rigid insert is that the insert can add significantly to the overall load-bearing capability of the panel, by distributing the load applied thereto by the product hangers.

Many users of slat wall systems mount the panels directly to a supporting wall with screw-threaded fasteners or to battens already attached to a wall using screws or nails driven into the battens. Advantageously, the fasteners or nails are concealed within the slots, so as not to spoil the appearance of the finished outer face of the panel. If a panel is mounted in this way and inserts for the slots are to be used, the inserts must be fitted to the slots after a panel has been mounted, but this requires access to one side edge of the panel, with sufficient clear space beyond that edge for the length of the inserts to be fitted to the panel. Often this is not possible, for example in the case of the last panel of a series thereof to be mounted side-by-side on a wall into a corner of a room, or for a panel to be mounted within an alcove or recess.

The above problem has previously been addressed for example in U.S. Pat. No. 5,138,803 by providing relatively flexible and resiliently deformable plastics material inserts, which may be sprung into the slots from the front face of the panel, after the panel has been attached to a wall by concealed fastenings, located within the slots. The insert is subjected to considerable deformation on being fitted into a slot and having regard to the length of an insert, it is very difficult to extract it from a slot, once fitted therein. To give sufficient flexibility, such inserts inevitably are of relatively thin wall-thickness, and so can be easily damaged by the fitting of hangers to the slots with inserts, or even by fitting and removing the inserts into and from the slots. More importantly, the use of such an insert cannot add to the overall load-bearing capability of the panel.

It is a principal aim of the present invention to provide a display panel having an insert which permits the attachment of the panel to a wall with concealed fasteners provided within the slots, whereafter the substantially rigid insert can be fitted to the slot from the front of the panel rather than by being slid into the slot from one end thereof.

According to this invention, there is provided a display panel having an outer face, at least one elongate slot of reentrant shape extending across the panel and having a mouth in the plane of the outer face, and an elongate insert having substantial rigidity in the lengthwise direction thereof and adapted to be received in the slot, which insert has a base portion from one side of which extends an arcuate leg, a channel extending along the length of the insert which channel is formed along the free edge region of the arcuate leg and is directed outwardly with respect to the curvature thereof, and from the other side of the base portion there extends an angled leg having a substantially planar first part lying generally parallel to the part of the arcuate leg near the base portion and a substantially planar second part turned outwardly with respect to the first part, an outwardly-directed abutment being formed along the free edge region of the second part and extending along the length of the insert, the spacing between said channel and said abutment being slightly greater than the width of the mouth of the reentrant slot and the insert being resiliently deformable whereby it may be entered into the slot with the base portion leading into a re-entrant part of the slot until the abutment engages the corner region between the outer face of the panel and one side of the slot, and the channel is engaged with the corner region between the outer face of the panel and the other side of the slot.

The insert of this invention is configured to permit its use with a T-shaped or L-shaped slot of a display panel so as to conceal the internal surfaces defining the slot, when the panel is in use. Though the insert may have considerable rigidity in the lengthwise direction thereof, the insert should have sufficient resilience to permit its insertion into the slot from the outer (front) face of the panel by minor resilient deformation of the two legs of the insert, towards each other. Further, the provision of the channel allows the insert to be secured in position, by the engagement of said corner region of the panel (between the outer face of the panel and said other side of the slot) with the channel. Thus, it becomes possible to mount the panel in a corner region of a room or in an alcove or other recess where there may be restricted access to the side edges of the panel, using concealed fixings furnished within the slots and then fit the inserts into the slots, by entering those inserts into the slots from the front surface of the panel.

Proper profiling of the insert allows it to be fitted with only minimal resilient deformation being required, to permit the engagement of said corner region with the channel. In turn, this allows the insert to be of a metal, which is relatively hard and durable compared to a plastics material. Thus, the insert preferably is of aluminium, an aluminium alloy or steel.

The cross-section of the insert advantageously allows it to be fitted to a slot by entering the base portion through the mouth of the slot, directing that base portion upwardly (presuming a vertical disposition for the panel) into the upper re-entrant part of the slot, with the arcuate leg of the insert lowermost. The insertion is continued until the abutment along the free edge region of the second part of the angled leg engages the corner region between the outer face of the panel and the upper side of the slot, at the mouth thereto. From that position, the insert may be rolled around the corner region, with the arcuate leg more or less running on the corner region between the outer face of the panel and the lower side of the slot, at the mouth thereto, without any significant deformation of the insert. Finally, as the channel extending along the length of the free edge region of the arcuate leg reaches the corner region between the outer face of the panel and the lower side of the slot, the arcuate leg may be sprung inwardly slightly to allow that corner region to engage in the channel, and then be retained there by the resilience of the insert.

Removal of the insert may easily be achieved merely by springing the arcuate leg inwardly slightly to free said corner region from the channel, and then rolling the insert out of the slot.

In order to achieve the above functionality, it is advantageous for the radius of curvature of the greater part of the arcuate leg to be centred substantially on or adjacent the abutment along the free edge region of the angled leg. Further, it is preferred for the angle between the first and second parts of the angled leg to be in the range of 85° to 120° and most preferably substantially 110°. The abutment of the second part of the angled leg conveniently comprises a rib upstanding from the free edge of that second part.

The channel provided on the arcuate leg preferably includes one rib upstanding from the free edge of the arcuate leg. A second rib may extend parallel to said one rib but disposed further from the free edge of the arcuate leg, to define the channel into which the corner region of the panel may be received.

It is envisaged that the insert will mostly be used with a panel having machined slots of a T-shaped profile. Such a slot will have a main part of generally rectangular cross-section communicating to the outer face of the panel through a portion of narrower cross-section. Though that portion of narrower cross-section may be of generally rectangular cross-section, it is preferred for it to be of rhomboidal trapezium section, to give adequate clearance for the insertion of the insert into the slot. Thus, that portion may have a pair of flanks extending from the front face of the panel towards the main part of the slot, which flanks lie at equal and opposite acute angles with respect to the front face and define with that front face said corner regions. In the alternative a slot may be provided in the panel which is irregular or otherwise more closely fits the insert. The requirement is that it should be possible to fit the insert into the slot without the outer walls of the insert fouling on the internal walls of the slot, and for the internal profile of the insert to allow the entry and location of a hanger.

This invention extends to a display system comprising a display panel having an insert of this invention as described above in combination with a product carrier having an arm and a hook projecting from one edge of the arm at an angle thereto, the carrier being engageable with the insert by moving the hook thereinto such that the free end of the hook lies adjacent the base portion of the insert, between the arcuate leg and the first part of the angled leg.

The hook of the product carrier preferably projects from the carrier arm at substantially 90° to the length of the arm. In this way, when the carrier is fully engaged with the insert mounted in a slot, the arm bears on the arcuate leg of the insert adjacent the channel thereof while the hook engages the first part of the angled leg, directly bearing on a face of the slot.

By way of example only, one specific embodiment of display panel and insert together arranged in accordance with this invention will now be described in detail, reference being made to the accompanying drawings in which:—

Figure 2:
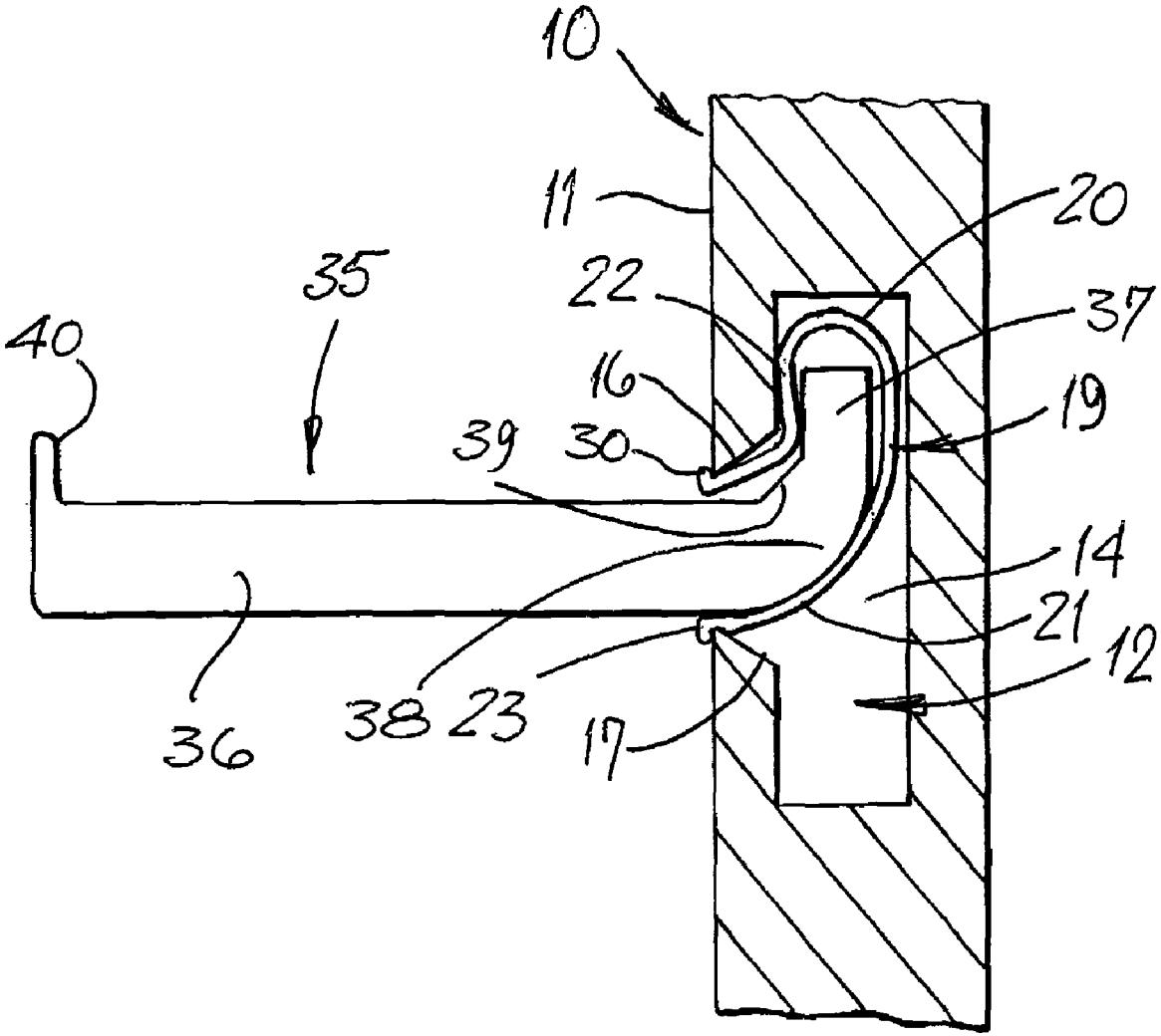
FIG. 2 is a vertical cross-section through a part of a display panel provided with a T-shaped slot and having the insert of FIG. 1 fitted therein, that slot and insert supporting a product carrier.

The display panel 10 shown in FIGS. 2 and 3 typically is of MDF but carries on its outwardly directed face 11 a plastics material skin, to give the overall panel an aesthetically pleasing appearance. Formed in the panel 10 is a plurality of parallel re-entrant slots 12 each of generally T-shaped cross-section, only one of which slots is shown in the drawings. The slots 12 are at an appropriate pitch for the intended use of the display panel but typically may be standardised at 100 mm. The panel 10 may have a width of about 1 m and each slot 12 extends from one edge of the panel to the opposed edge, at 90° to those edges.

Each slot 12 has a generally rectangular main portion 14, opening through the outer face 11 of the display panel 10 through a narrower portion 15 of a generally rhomboidal trapezium shape. That narrower portion 15 thus has side flanks 16, 17 extending at equal but opposite angles to the outer face 11 of the panel 10. Each such slot may be formed in the panel by means of a rotary cutter the axis of which is normal to the plane of the panel, the cutter being entered into the panel from one edge and then traversed across the panel to the opposed edge. Multiple slots may be formed simultaneously by a machine having ganged cutters at the required spacing.

Figure 1:
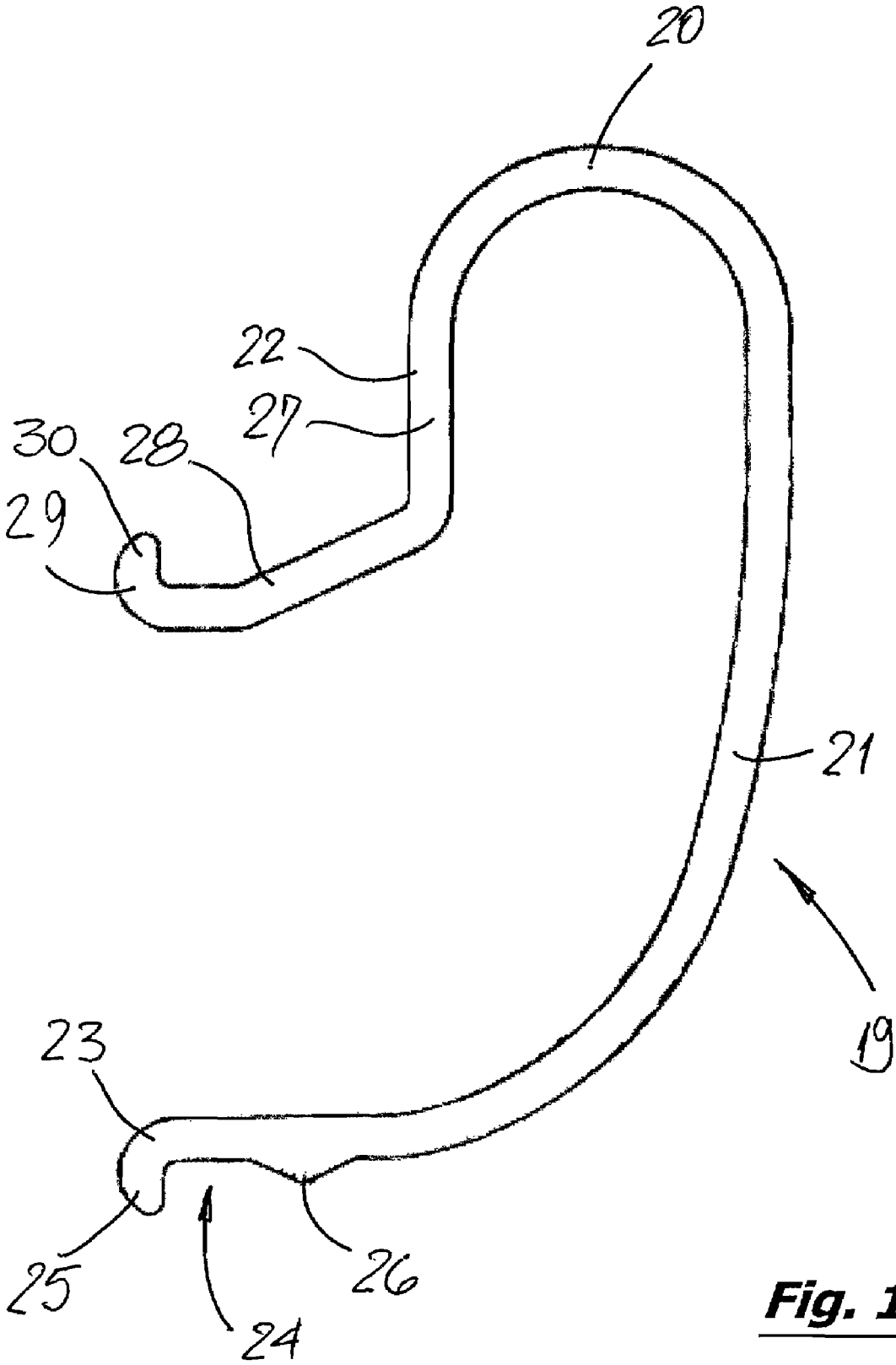
FIG. 1 is a cross-section through an elongate insert for fitting to a display panel provided with a T-shaped slot.

FIG. 1 shows on an enlarged scale an insert 19 for the slot 12, the insert also being shown in FIGS. 2 and 3. The insert typically is an aluminium alloy extrusion so having significant rigidity along its length as well as a good surface finish. The insert 19 is of the same length as the slot 12 into which it is fitted and so typically will be 1 m in length. Viewed in cross-section (as in the drawings), the insert has a U-shaped base portion 20 from one side of which extends an arcuate leg 21 and from the other side of which extends an angled leg 22. The arcuate leg is curved towards the angled leg 22 and has two radii of curvature, the greater radius being adjacent the U-shaped base portion 20 and this merges into the smaller radius of curvature, adjacent the free edge 23 of the angled leg 22. Along the free edge 23 of the arcuate leg, there is formed a channel 24 extending for the full length of the insert, defined by a rib 25 at the free edge itself and a smaller, generally triangular rib 26 spaced from the rib 25.

The angled leg 22 has a substantially planar first part 27 lying generally parallel to the part of the arcuate leg 21 nearer the base portion (where the curvature of the arcuate leg is relatively small) and a substantially planar second part 28 turned outwardly with respect to the first part. At the free edge 29 of the second part 28, there is formed a short further planar section merging into an outwardly directed abutment 30 extending for the full length of the insert.

FIGS. 3A to 3D show the series of steps for inserting the insert 19 into a slot 12 of the display panel 10. Normally, the display panel will be secured to a vertical wall by means of screw-threaded fasteners (not shown) passing through holes formed in the panel and screwed into the wall. The holes should be formed within the slots between the side flanks 16,17 to extend perpendicularly to the outer face 11 of the panel, so that the fasteners may be concealed by the inserts when fitted to the slots.

Figure 3B:
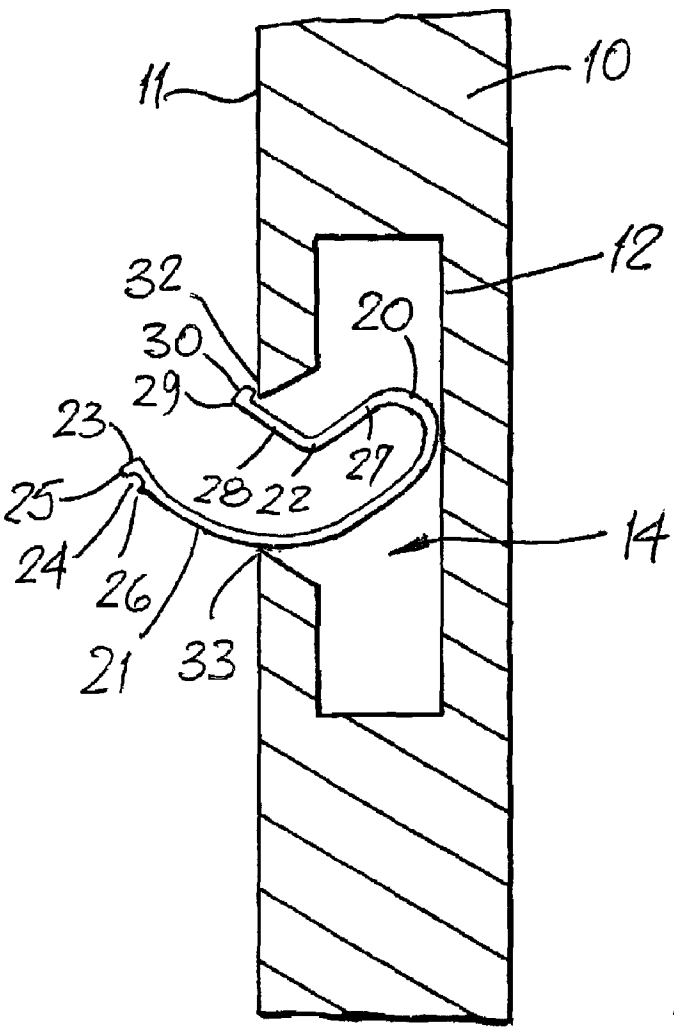
FIGS. 3A, 3B, 3C and 3D are four drawings showing the successive steps of fitting the insert into the slot of a display panel.
Figure 3A:
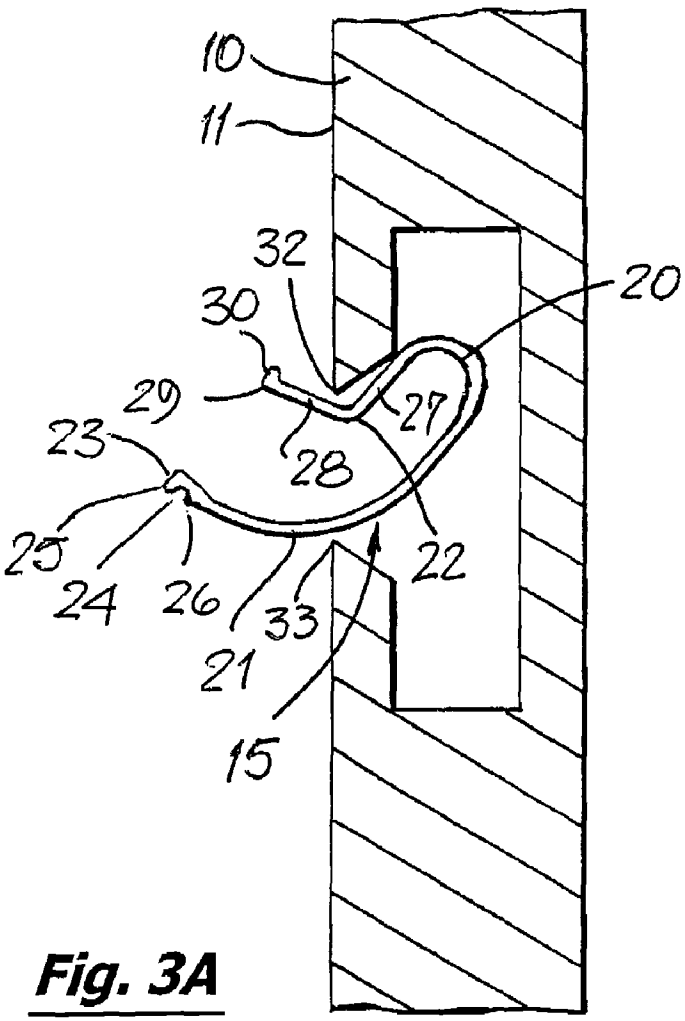
Figure 3D:
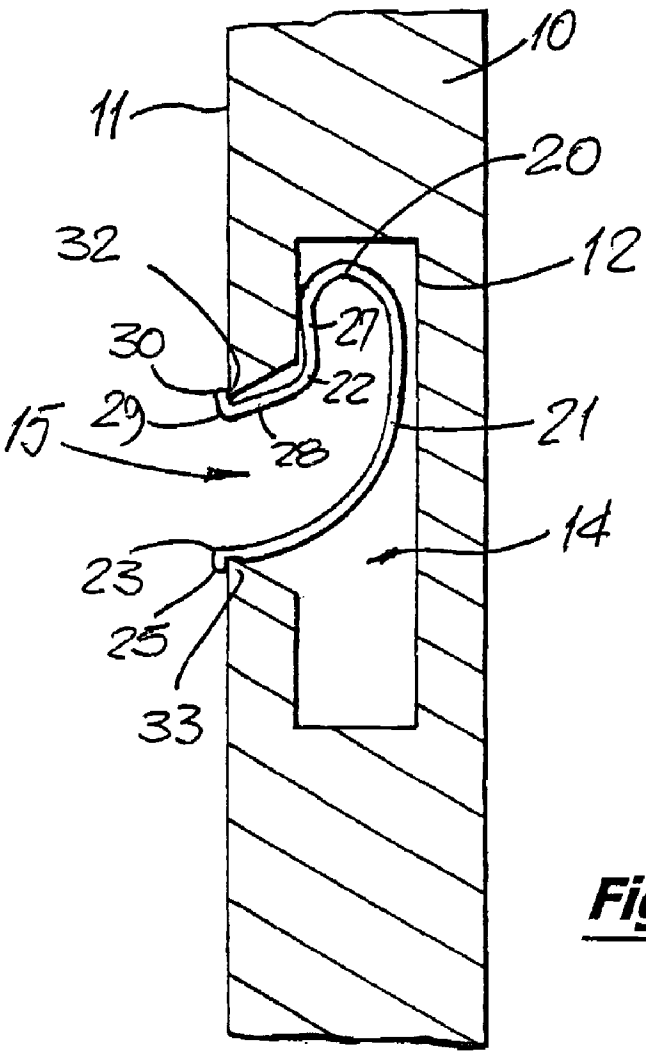
Figure 3C:
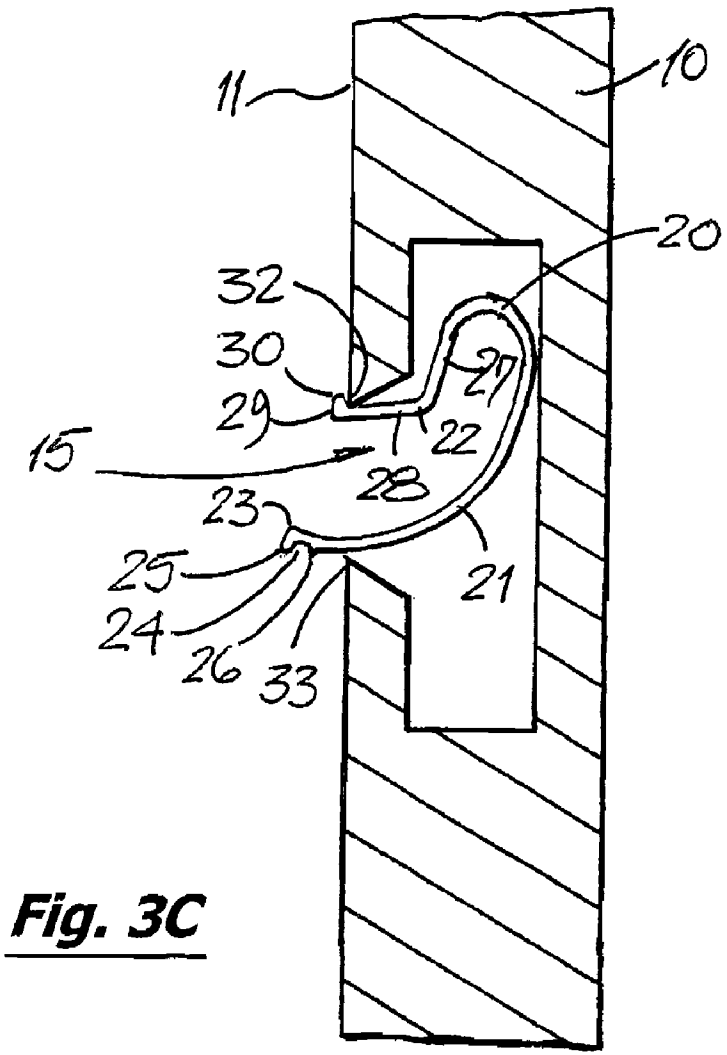

The base portion 20 of the insert is fed between the side flanks 16,17 with the angled leg 22 uppermost, so as to move the base portion 20 into the upper region of the slot 12, as shown in FIG. 3A. The insert is pushed generally rearwardly until the abutment 30 on the second part 28 of the angled leg 22 engages the corner region 32 between the outer face 11 of the panel above the slot and the upper side flank 16 (FIG. 3B). Then, the free edge 23 of the arcuate leg 21 is pushed rearwardly, so causing the insert as a whole to pivot about the corner region 32, so moving the base portion 20 higher into the slot 12 (FIG. 3C). Continued pressure on the insert brings the channel 24 immediately adjacent the lower corner region 33 between the outer face 11 of the panel below the slot and the lower side flank 17, the base portion of the insert then being disposed within the upper part of the slot. Further pressure on the insert then springs the arcuate leg towards the free edge 29 of the angled leg 22, so allowing the lower corner region 33 to engage in the channel 24 (FIG. 3D). In this position, the insert is held in place, by virtue of the natural resilience of the insert material maintaining the engagement of the lower corner region 33 in the channel 24 of the arcuate leg 21. The insert is thus deformed only as the corner region 33 of the panel slot "clicks" into the channel 24 of the insert.

When fitted in the above manner, the slot 12 carrying the insert 19 is ready for use with a hanger such as that shown in FIG. 2. The hanger 35 has a main arm 36 together with a hook part 37 provided at one end of the arm. That hook part is profiled so as to be receivable within the insert 19, between the arcuate and angled legs 21,22 thereof. The transition zone 38 between the arm and hook part is radiused externally, with a curvature broadly corresponding to that of the arcuate leg 21. Opposite that external curvature of the transition zone, the hanger has a flat angled face 39. The configuration of the transition zone is such that the hook part 37 may be entered into the insert with the arm of the hanger more or less parallel to the outer face 11 of the panel 10 and projecting upwardly from a slot with which the hanger is to be engaged, the arm then being pivotable downwardly to move the hook part 37 nearer the base portion 20 of the insert and to have the radiused external curvature of the transition zone 38 bearing on the inwardly directed face of the arcuate leg 21. A load then carried by the hanger will bring the hook part into firm engagement with the first part 27 of the angled leg 22 and so press that first part firmly into engagement with an inner face of the slot, with the downward load carried by the region of the arcuate leg nearer the lower corner region 33.

As shown in FIG. 2, the arm 36 may have an upstanding lip 40 at its end remote from the hook part 37, to assist the retention of products thereon. The hanger as a whole may have a small extent in the direction of the length of the slot, in order that products to be displayed may have an aperture for receiving the arm so as to be suspended therefrom, or may have a more significant extent in that direction such that the hanger may serve as a shelf for carrying the products to be displayed.

In the drawings, the slot 12 in the panel 10 is shown as of rectangular cross-section, with a narrower portion 15 of a rhomboidal trapezium shape. This gives a sharp corner which is received in the channel 24 of the insert, but other shapes could be employed both for the narrower portion and the main area of the slot. Further, the main area could be more L-shaped, or could fit more closely than is shown to the insert, for example by rounding the internal corners of the slot. The principal requirement is that it should be possible to fit the insert into the slot without significant deformation of the insert, and that the insert deforms resiliently at the end of the procedure merely to permit engagement of the outer corner of the slot with the channel, to hold the insert in position. Further, the internal profile of the insert must be such that a hanger may be engaged therewith in a secure manner, and when so engaged, there is adequate location for the hanger.

The invention claimed is:

1. A display panel having an outer face, at least one elongate slot of re-entrant shape extending across the panel and having a mouth in the plane of the outer face, and an elongate insert of a resilient metal and having substantial rigidity in the lengthwise direction thereof, said insert being adapted to be received in the slot and having a base portion from one side of which extends an arcuate leg, a first rib upstanding from a free edge of the arcuate leg, a second rib also upstanding from the arcuate leg and extending parallel to said first rib, the second rib being closely spaced from but being disposed further from the free edge of the arcuate leg than said first rib whereby a distinct channel extending along the length of the insert is provided along the free edge of the arcuate leg, said channel being defined by said first and second ribs and being directed outwardly with respect to the curvature of the free edge region of the arcuate leg, and from the other side of the base portion there extends an angled leg having a substantially planar first part lying generally parallel to the part of the arcuate leg near the base portion and a substantially planar second part turned outwardly with respect to the first part, an outwardly-directed abutment being formed along the free edge region of the second part and extending along the length of the insert, the spacing between said channel and said abutment being slightly greater than the width of the mouth of the re-entrant slot and the insert being resiliently deformable whereby it may be entered into the slot with the base portion leading into a re-entrant part of the slot until the abutment engages the corner region between the outer face of the panel and one side of the slot, and the channel is engaged with the corner region between the outer face of the panel and the other side of the slot.

2. A display panel as claimed in claim 1, wherein the angle between the first and second parts of the angled leg is in the range of 85° and 120°.

3. A display panel as claimed in claim 2, wherein the angle between the first and second parts of the angled leg is substantially 110°.

4. A display panel as claimed in claim 1, wherein the abutment comprises a rib upstanding from the free edge of the second part of the angled leg.

5. A display panel as claimed in claim 1, wherein the greater part of the arcuate leg is of substantially constant radius of curvature.

6. A display panel as claimed in claim 5, wherein the radius of curvature is substantially centred on or adjacent the abutment on the angled leg.

7. A display panel as claimed in claim 1, wherein the slot has a main part of generally rectangular cross-section communicating to the outer face of the panel through a portion of a narrower cross-section.

8. A display panel as claimed in claim 7, wherein the portion of narrower cross-section is of rhomboidal trapezium cross-sectional shape.

9. A display panel as claimed in claim 8, wherein said portion of the slot has a pair of flanks extending from the front face of the panel towards the main part of the slot, which flanks lie at equal and opposite acute angles with respect to the outer face of the panel.

10. A display panel as claimed in claim 1, wherein the panel is made of a ligneous-based material.

11. A display panel as claimed in claim 1, wherein the panel has a plurality of like slots extending parallel to each other across the outer face of the panel and each slot is provided with a like insert.

12. A display system comprising a display panel as claimed in claim 1 in combination with a product carrier having an arm and a hook projecting from one edge of the arm at an angle thereto, the carrier being engageable with the insert by moving the hook thereinto such that the free end of the hook lies adjacent to the base portion of the insert, between the arcuate leg and the first part of the angled leg.

13. A display system as claimed in claim 12, wherein the hook projects from the arm at substantially 90° to the length of the arm.

14. A display system as claimed in claim 13, wherein when the carrier is fully engaged with the insert, the arm bears on the arcuate leg adjacent the channel thereof while the hook engages the first part of the angled leg.

15. A display system as claimed in claim 1, wherein the insert is made of an aluminum alloy.

* * * * *